US005683229A

United States Patent [19]

Stoll et al.

[11] Patent Number: 5,683,229

[45] Date of Patent: Nov. 4, 1997

[54] HERMETICALLY SEALED PUMP FOR A REFRIGERATION SYSTEM

[75] Inventors: Thomas D. Stoll, Grand Rapids; Lawrence Edward Switek, Hopkins, both of Mich.

[73] Assignee: Delaware Capital Formation, Inc., Wilmington, Del.

[21] Appl. No.: 475,073

[22] Filed: Jun. 7, 1995

Related U.S. Application Data

[62] Division of Ser. No. 276,054, Jul. 15, 1994, Pat. No. 5,544,496.

[51] Int. Cl.[6] ..... F04B 17/00

[52] U.S. Cl. ..... 417/366; 417/410.3; 417/902; 418/268

[58] Field of Search ..... 418/259, 150, 418/268; 417/902, 366, 410.3

[56] References Cited

U.S. PATENT DOCUMENTS

| | | | |
|---|---|---|---|
| Re. 30,994 | 7/1982 | Shaw . | |
| 2,091,752 | 8/1937 | Davis . | |
| 2,152,056 | 3/1939 | Kenney et al. . | |
| 2,178,425 | 10/1939 | Johnson . | |
| 2,312,514 | 3/1943 | Zimmerer | 417/902 |
| 3,015,222 | 1/1962 | Wellborn et al. . | |
| 3,399,627 | 9/1968 | Jeep, Jr. et al. . | |
| 3,639,085 | 2/1972 | Bertsch et al. . | |
| 3,790,311 | 2/1974 | Butts et al. . | |
| 3,865,520 | 2/1975 | Kramer et al. . | |
| 3,897,179 | 7/1975 | Fussner et al. | 417/366 |
| 3,936,243 | 2/1976 | Gakenholz | 417/366 |
| 4,021,166 | 5/1977 | Glanvall et al. . | |
| 4,181,474 | 1/1980 | Shaw . | |
| 4,505,649 | 3/1985 | Masuda et al. | 418/259 |
| 4,514,157 | 4/1985 | Nakamura et al. . | |
| 4,557,677 | 12/1985 | Hasegawa . | |
| 4,601,644 | 7/1986 | Gannaway . | |
| 4,629,406 | 12/1986 | Tantardini | 417/268 |
| 4,730,994 | 3/1988 | Maertens . | |
| 4,752,195 | 6/1988 | Friedrich et al. | 418/259 |
| 4,762,471 | 8/1988 | Asanuma et al. . | |
| 4,768,936 | 9/1988 | Etemad et al. . | |
| 4,802,830 | 2/1989 | Nakajima | 418/150 |
| 4,838,767 | 6/1989 | Ohe et al. . | |
| 4,889,475 | 12/1989 | Gannaway et al. . | |
| 4,898,526 | 2/1990 | Sakamaki et al. . | |
| 4,934,905 | 6/1990 | Richardson, Jr. . | |
| 5,026,263 | 6/1991 | Iwata . | |
| 5,051,076 | 9/1991 | Okoma et al. . | |
| 5,083,909 | 1/1992 | Kunsemiller et al. . | |
| 5,154,593 | 10/1992 | Konishi et al. . | |
| 5,169,299 | 12/1992 | Gannaway . | |
| 5,188,522 | 2/1993 | Hara . | |
| 5,242,280 | 9/1993 | Fujio . | |
| 5,261,796 | 11/1993 | Niemiec et al. . | |
| 5,431,552 | 7/1995 | Schuller et al. . | |

FOREIGN PATENT DOCUMENTS

| | | | |
|---|---|---|---|
| 3220033 | 12/1982 | Germany | 418/259 |
| 119692 | 5/1990 | Japan | 418/259 |

*Primary Examiner*—Charles G. Freay

*Attorney, Agent, or Firm*—Varnum, Riddering, Schmidt & Howlett LLP

[57] ABSTRACT

A refrigeration system is disclosed in which negative energy storage is provided to significantly reduce electrical energy consumption during peak air conditioning hours. A transfer pump is provided in the system for pumping condensed and mixed phase refrigerant from the negative energy storage to an evaporator coil where it absorbs heat energy from an air conditioned space. The transfer pump is a positive displacement pump employing a rotor and vanes rotating in a pumping chamber. Dual inlets and discharges from the pumping chamber are located to balance forces on the rotor. The inlets enter the pumping chamber radially. A hermetic enclosure seals the pump and an electric drive motor to eliminate dynamic seals within the pump and thereby greatly reduce leakage of refrigeration from the system. A refrigeration overfeed system using a hermetically sealed pump according to the invention is also disclosed.

17 Claims, 6 Drawing Sheets

HERMETICALLY SEALED PUMP FOR A REFRIGERATION SYSTEM

CROSS REFERENCE TO RELATED APPLICATION

This application is a divisional of U.S. Ser. No. 08/276,054 filed Jul. 15, 1994, now U.S. Pat. No. 5,544,496.

BACKGROUND OF THE INVENTION

1. Field of the Invention

This invention relates to a hermetically sealed, balanced rotor pump. In one of its aspects, the invention relates to a positive displacement, sealless, balanced rotor, vane pump.

2. State of the Prior Art

Refrigeration and air conditioning systems typically include a pump used to circulate refrigerant throughout the system. One such an air conditioning system is described in the Uselton et al. U.S. Pat. No. 5,211,029 issued May 18, 1993 which discloses a standard freon-based compressor driven condensing and evaporating type refrigeration system into which has been incorporated a tank of negative energy storage media. Coils are provided to circulate the refrigerant of the refrigeration system through the tank of negative energy storage media. A transfer pump is provided for drawing condensed and chilled refrigerant from the tank of negative energy storage media and passing it through the evaporator in the refrigeration system.

Pumps used in refrigeration systems must be able to run continuously over a long period of time, be relatively long-lived without breakdowns, must be efficient in operation, and must be able to move mixed phase (gas/liquid) fluids as well as liquid refrigerant. Often, the pump chamber is filled only with vapor phase refrigerant upon start-up so that the pump must be self priming and have a superior dry running capability. Further, such pumps must also be free from leakage of the refrigerant. Several pumps have been proposed for use in the Uselton et al. refrigeration system. One such pump is a gear pump as the transfer pump. However, most refrigerants typically have very low viscosity and therefore provide insufficient lubrication to prevent rapid wear of moving parts of pumps and compressors. As the gears in a gear pump wear over the life of the pump, the slip of fluid past the rotating gears greatly reduces their efficiency and capacity at a given pressure, especially with such low viscosity pumping liquids.

Centrifugal pumps are often used to pump liquids and have many advantages in this service. However, as the media in the negative energy storage tank warms up, the refrigerant passing through the tank may not be completely condensed and may enter the transfer pump in a mixed phase state. Centrifugal pumps are inappropriate for pumping mixed phase media.

Many types of refrigerants used in evaporative refrigeration systems are potentially harmful to the environment, and newer refrigerants may pose health risks. Also, leakage results in system ineffectiveness. Therefore, it is desirable to minimize all leaks and discharges of refrigerants from the system. Due to its low viscosity, refrigerant is particularly susceptible to leakage past dynamic seals on a pump shaft as it passes through the pump housing.

A pump used in a refrigeration or air conditioning system as described above must permit little or no leakage from the pumping chamber and be capable of pumping a potentially corrosive fluid typical of liquid refrigerants. Further, it must be adapted for long life with little or no maintenance.

Niemiec et al. U.S. Pat. No. 5,261,796 issued Nov. 16, 1993, discloses a balanced-rotor vane pump powered by an electric motor for use in hydraulic applications. However, the Niemiec et al. pump is not suitable for the mixed-phase pumping required by refrigeration and air conditioning systems.

Due to sliding friction between moving parts, such as rotors, gears, pistons, bearings, etc., pumps and compressors have previously been designed with an oil sump and some means of separation and/or oil return to ensure proper fluid film between parts in relative motion. Typically, a small amount of oil is mixed with the refrigerant to help lubricate moving parts. For some refrigerants, the oil may not be miscible which creates special design problems due to oil fouling of evaporator or condenser tubes, filters, etc. HCFC-22 is particularly miscible with oil, HFC-134a is hardly miscible and ammonia is immiscible with oil.

SUMMARY OF THE INVENTION

A constant volume, balanced rotor, hermetically sealed vane pump according to the invention comprises an hermetic enclosure comprising a pump housing. The hollow pump housing has a circumferential wall defining a generally elliptical rotor chamber having opposed circular portions, opposed cam portions at some angular displacement from the circular portions and an inlet port connected to each cam portion at a leading edge thereof. The rotor chamber is further defined by an end wall at each axial end of the rotor chamber and has an outlet port connected to each of the cam portions at a trailing edge thereof. A cylindrical pump rotor is rotatably supported within the pump housing for rotation in the rotor chamber. It has a plurality of radially extending, slidably mounted vanes adapted to form a constant volume pumping chamber defined between each pair of adjacent vanes, the rotor, and the circumferential, and end walls at the cam portions between each inlet port and each outlet port.

A motor for the pump preferably comprises a stator mounted within a motor homing, a motor rotor disposed within the stator for rotation and a motor shaft mounted to the motor rotor and extending axially from an axial end of the rotor. The motor housing has bearing supports mounting motor bearings at the ends of the motor rotor that support the motor shaft. A slidable drive coupling between the motor shaft and the pump rotor allows for slight axial and radial movement between the two. A discharge port is provided through the motor housing. In a first alternative embodiment, the pump is driven by a hermetically-sealed canned motor coupled mechanically to the pump. In a second alternative embodiment, the motor is magnetically coupled to the pump.

Preferably, the end walls of the pump comprise disk bearings mounted within the pump housing and the pump rotor is supported on the disk bearings. The disk bearings are preferably formed of a self-lubricating material.

The outlet ports through the end wall preferably communicate with the motor housing whereby the fluid to be pumped can cool the motor bearings and one of the bearing supports can have an opening for liquid to pass through. Preferably, the motor bearings are self-lubricating.

The pump rotor can be provided with radial splines extending axially and the motor shaft can be provided with mating radial splines extending axially whereby the splines on the motor shaft and pump rotor slidably couple the motor shaft to the pump rotor. Alternatively, the pump rotor can have an axially extending keyway and the shaft can have a radially extending pin disposed within the keyway whereby the motor shaft slidably couples to the pump rotor.

DETAILED DESCRIPTION

Figure 1:
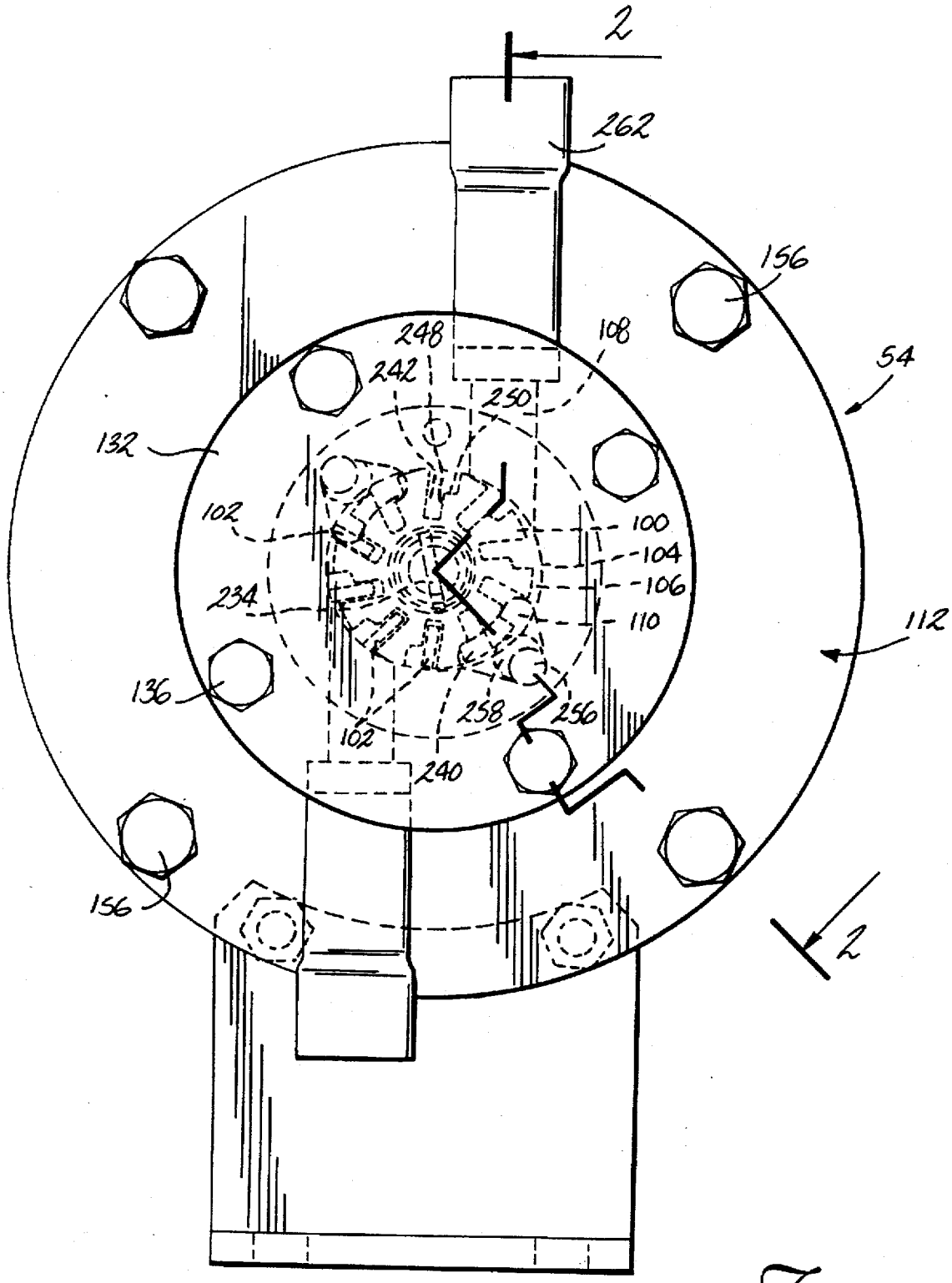
FIG. 1 is a end view of a transfer pump according to the present invention.
Figure 2:
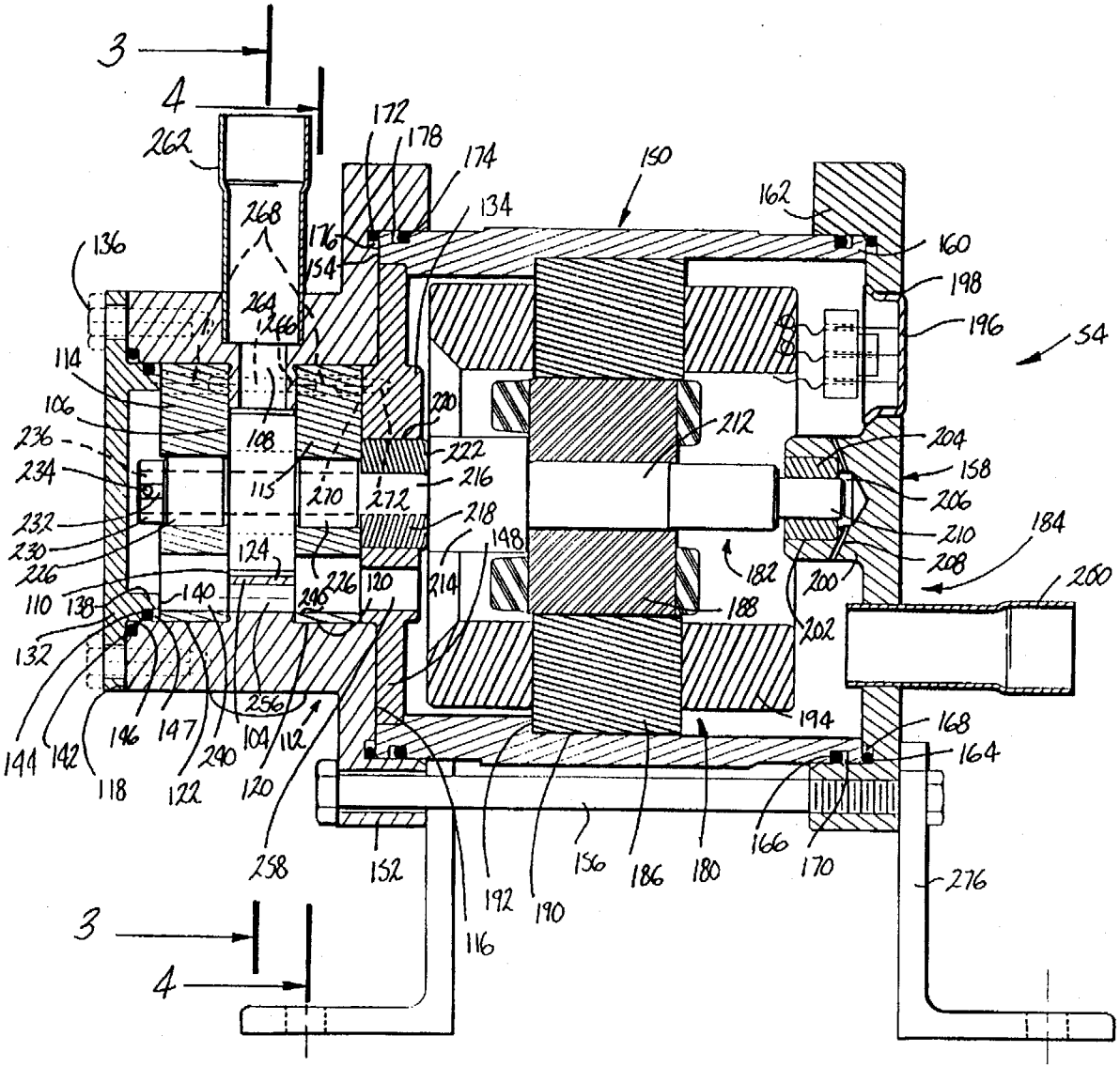
FIG. 2 is a view of the pump shown in FIG. 1 and taken along lines 2—2 of FIG. 1.
Figure 4:
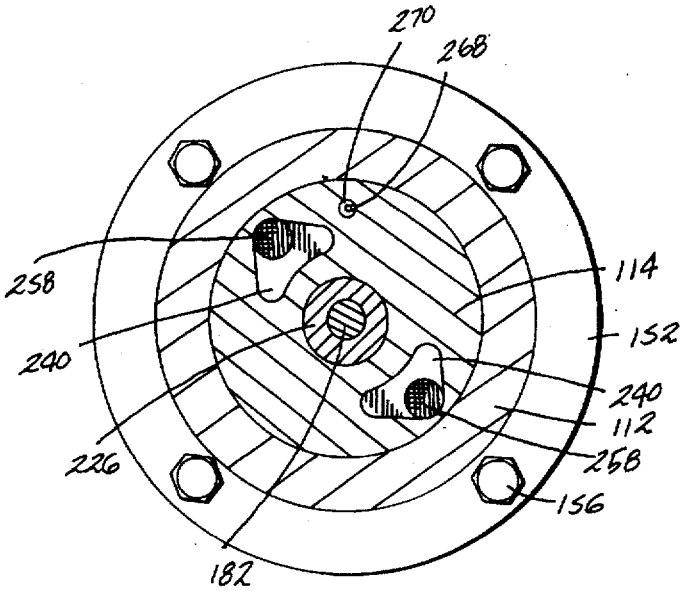
FIG. 4 is a sectional view taken along line 4—4 of FIG. 2.

Turning now to the drawings and to FIGS. 1 and 2 in particular, pump 54 comprises a pump housing 112, an end cover 132, a pair of end disks 114, 115, and generally a slotted pump rotor 100 carrying a plurality of axial vanes 102. The end disks 114, 115 can be formed of a wear-resistant, self-lubricating material, for example, a plastic and carbon composite material. The end cover 132 is discoidal in shape and mounts to the cylinder out-board side 118 by means of four bolts 136 passing axially through the end cover 132 and into the pump housing 112. The pump rotor 110 is rotatable within a cam ring 104 forming a pumping chamber 106. Suction is provided through two radial inlet ports 108 which are connected to inlet fittings 262.

The rotor chamber 106 is formed of the cylindrical pump housing 112 and a pair of opposing end disks 114, 115. The pump housing 112 comprises an in-board side 116 and an out-board side 118. An in-board bore 120 extends co-axially into the pump housing 112 from the in-board side 116, and an opposing out-board bore 122 extends coaxially into the pump housing 112 in alignment with the in-board bore 120 from the out-board side 118. The end disk 115 fits snugly within the in-board bore 120, and the other end disk 114 fits snugly within the out-board bore 122. The cam ring 104 is preferably integrally formed with the pump housing 112 between the in-board and outboard bores 120 and 122.

Figure 3:
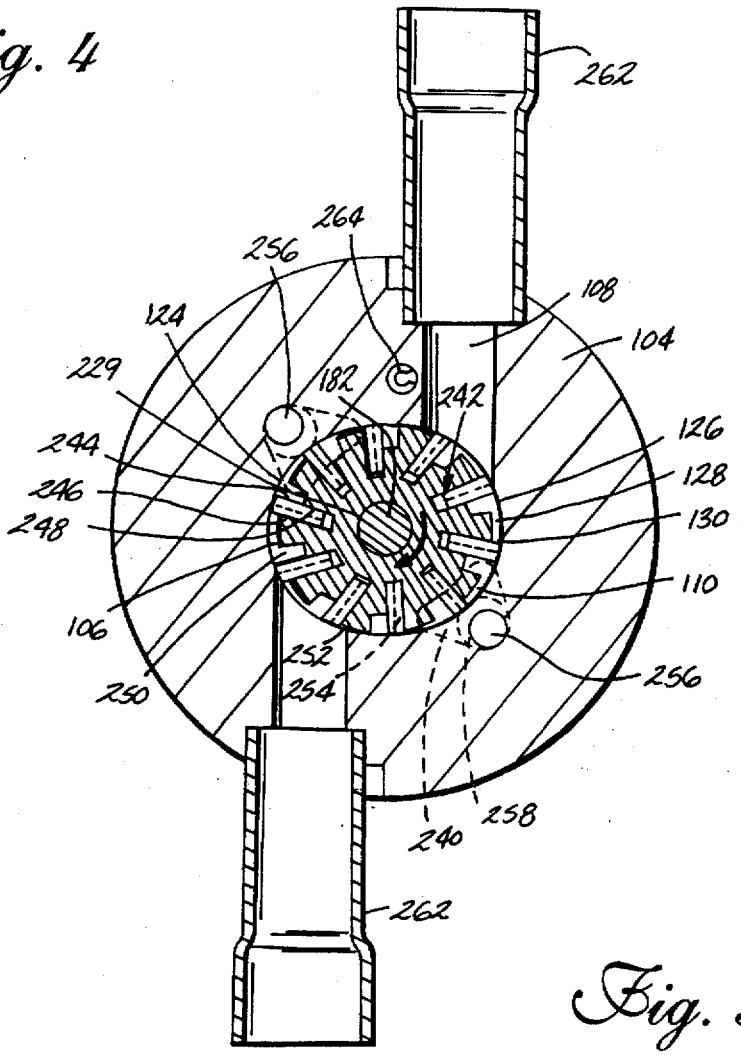
FIG. 3 is a sectional view taken along line 3—3 of FIG. 2.

As best seen in FIG. 3, the rotor chamber 106 comprises a bore 124 through the cam ring 104. The bore 124 is essentially circular and has two "drops" 126 located 180° apart of identical construction to give the bore 124 a slightly elliptical appearance. Each of the drops 126 comprises a slight enlargement of the chamber bore 124 and extends from one of the inlets 108 to one of the discharge portions 110. A central section 128 of each drop 126, defined as being completely between the inlet 108 and discharge 110, has a constant radius so that pumping chambers 130 formed between the drops 126, pump rotor 100 and vanes 102 have a constant volume as the pump rotor 100 rotates within the rotor chamber 106.

Returning to FIG. 2, the end cover 132 at the housing out-board side 118 and a hub 134 at the housing in-board side 116 contain the disks 114, 115 and rotor 100 within the pump housing 112. An inwardly directed annular flange 138 on the end cover 132 is received within and abuts the out-board bore 122. Also, an inside edge 140 of the flange 138 abuts the disk 114. O-rings 142 and 144 are received in grooves 146 and 147 in housing out-board side 118 and end cover annular flange 138, respectively, to hermetically seal the end cover 132 to the pump housing 112.

The hub 134 is also discoidal in shape and fits within the in-board bore 120. An annular flange portion 148 extends outwardly radially on the hub 134 so that the hub 134 is positively located within the pump housing 112 by abutment between the pump housing 112 and the annular flange 148. The hub 134 also abuts the disk 115 to position and hold it within the pump housing 112.

The hub 134 is held in close abutment with the pump housing 112 by a cylindrical motor housing 150. An inwardly directed annular flange 152 on the pump housing 112 receives an inner end 154 of the motor housing 150. At least four axial bolts 156 pass through the annular flange 152 and are received within an end bell 158 at an outer end 160 of the motor housing 150. Thus, the compression applied by the bolts 156 pulls the motor housing 150 into abutment with the hub annular flange 148 and pump housing 112.

An inwardly directed annular flange 162 on the end bell 158 faces the inwardly directed annular flange 152 on the pump housing 112 and it is the annular flange 162 which receives the bolts 156. Thus, the bolts 156 lie radially outwardly of the motor housing 150. O-rings 164 and 166 are disposed within grooves 168 and 170 in the end bell 158 and motor housing 150. They abut the motor housing outer end 160 and end bell annular flange 162, respectively, and hermetically seal the end bell 158 to the motor housing 150. O-rings 172 and 174 are disposed within grooves 176 and 178 in the pump housing 112 and motor housing 150 to hermetically seal the pump housing 112 to the motor housing 150. A motor 180 is disposed within the motor housing 150. A motor shaft 182 extends from the motor 180 through the pump rotor 100. Thus, all of the pump components are disposed within a hermetically sealed enclosure 184 comprised of the end bell 158, motor housing 150, pump housing 112 and end cover 132. This obviates the need for dynamic seals between the pump housing 112 and motor 180 which are an inherent source of leakage in prior applications.

Figure 6:
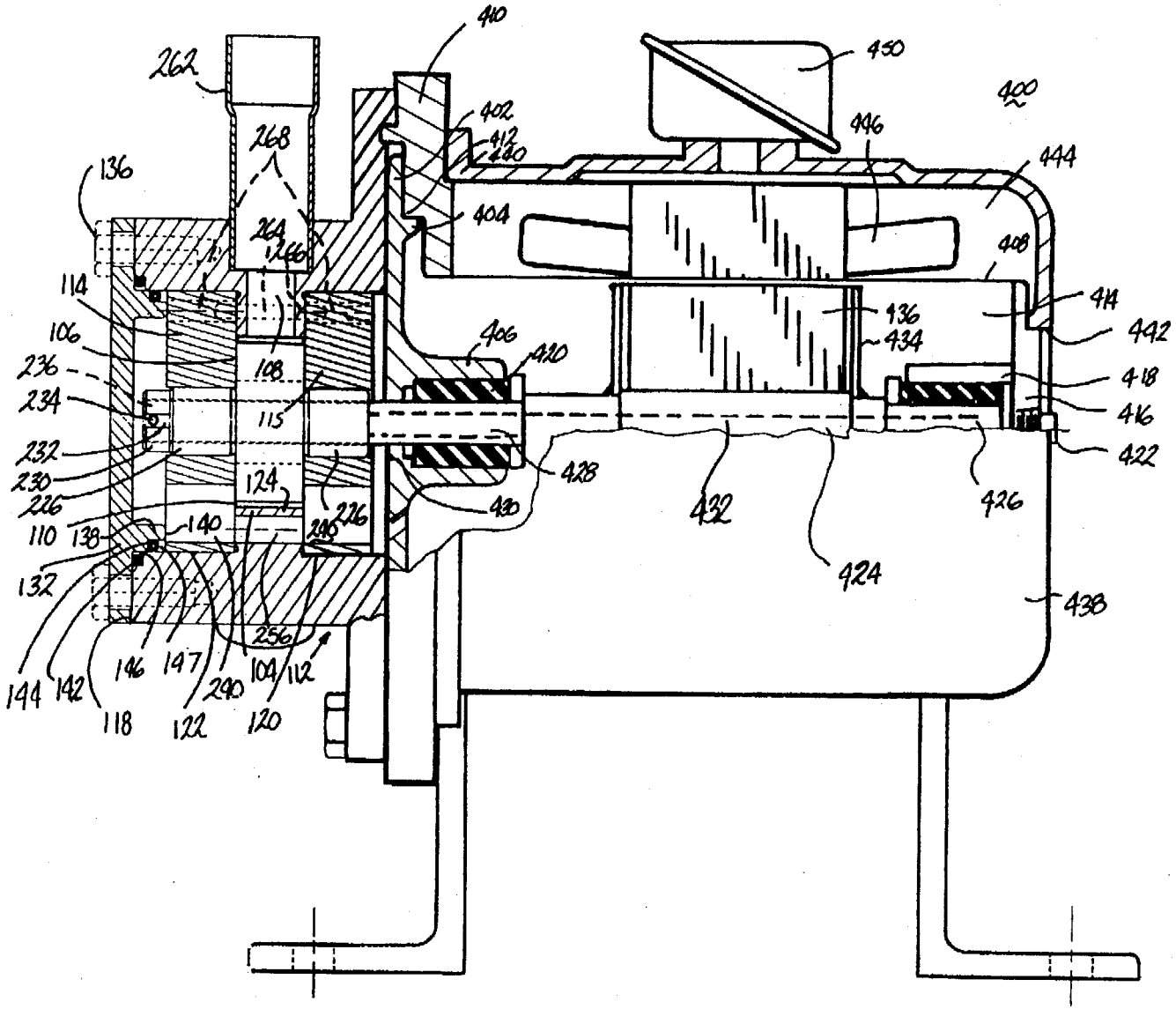
FIG. 6 is a view of the pump taken along lines 2—2 of FIG. 1 showing a first alternative embodiment of the pump motor.
Figure 7:
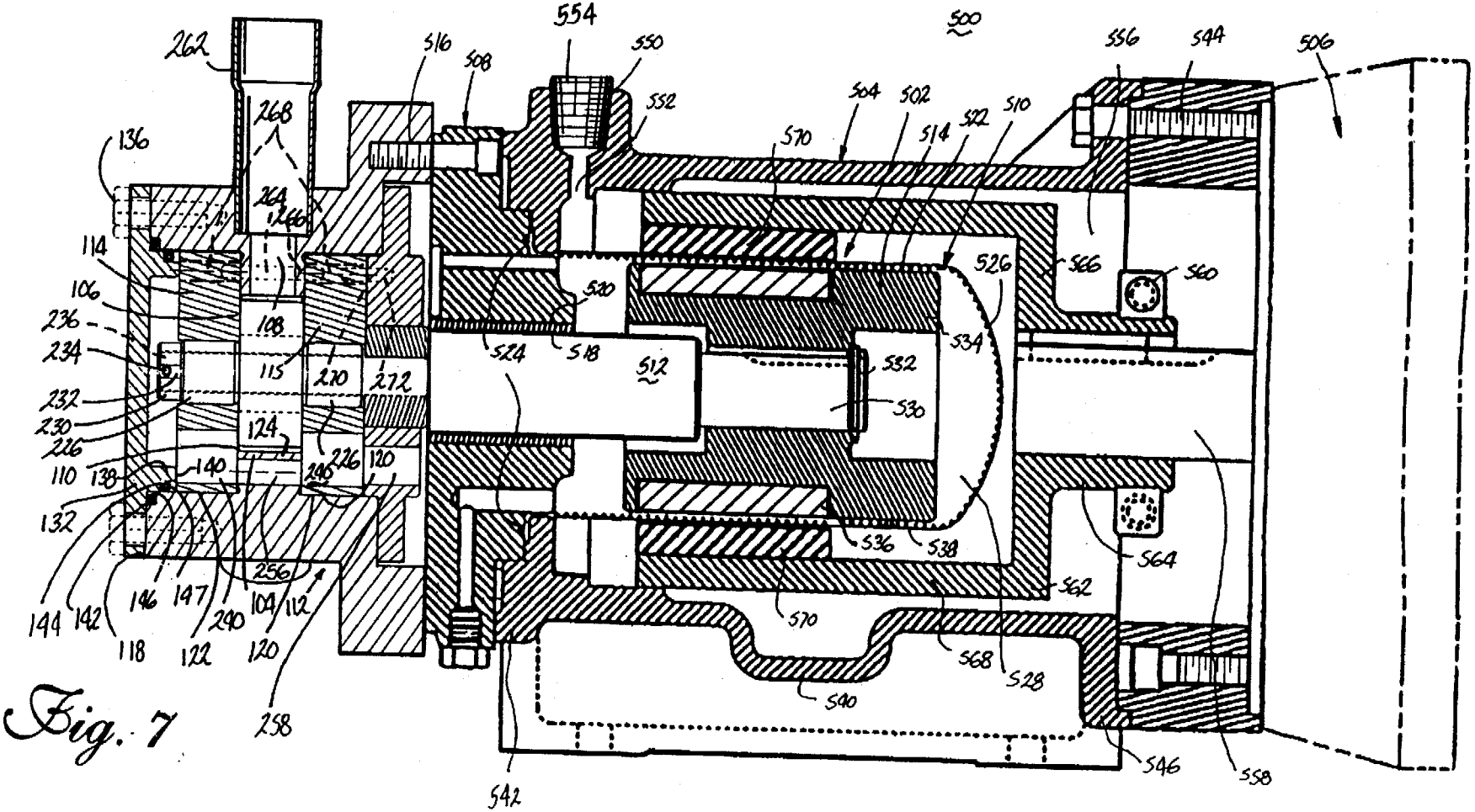
FIG. 7 is a view of the pump taken along lines 2—2 of FIG. 1 showing a second alternative embodiment of the pump motor.

The pump 54 is thus a "sealless" pump as it contains no dynamic shaft seals on the pump rotor 100. Sealless pumps may fall into one of three categories: canned pumps, magnetically coupled pumps and hermetic pumps. In a canned pump, at least the pump and motor rotor are contained within a hermetically sealed housing. The magnetic fields from the stator must pass through a can enclosing the motor rotor. In a magnetically coupled pump, a hermetically sealed enclosure contains the pump and a driven magnet. A drive magnet affixed to an electric motor magnetically couples with the driven magnet to operate the pump. In a hermetic pump, the motor and pump are sealed within a hermetic enclosure. Further, the motor stator is not separated from the pumped fluid by a can, but rather it is bathed within the fluid. The pump 54 is of the hermetic configuration in this embodiment. FIG. 6 shows pump 54 driven by an above-described canned motor while FIG. 7 shows pump 54 magnetically coupled to a motor.

The motor 180 has a stator 186 and rotor 188 of a type commonly known in the art. The stator 186 is secured to an inner surface 190 of the motor housing 150, as by an interference fit or other mechanical fastening means. An annular shoulder 192 within the motor housing 150 positively locates of the stator 186 within the motor housing 150 and eases assembly. The stator 186 is provided with windings 194 and is wired to a point exterior of the hermetic enclosure 184 by an electrical connector 196 received within an aperture 198 in the end bell 158. The electrical connector 196 may be of any of the types well-known in the art for such service which maintains the hermetic seal of the hermetic enclosure 184.

A cylindrical hub 200, integrally formed with the end bell 158, extends towards the motor 180. It has a first bore 202 receiving a cylindrical carbon bushing bearing 204 and a first end 210 of the motor shaft 182 rotates within the bushing bearing 204. A second, smaller diameter, bore 206 extends coaxially into the cylindrical hub 200 from the first bore 202 and intersects two sloping bores 208 passing radially at an approximately 60° angle into the hub 200.

Figure 5:
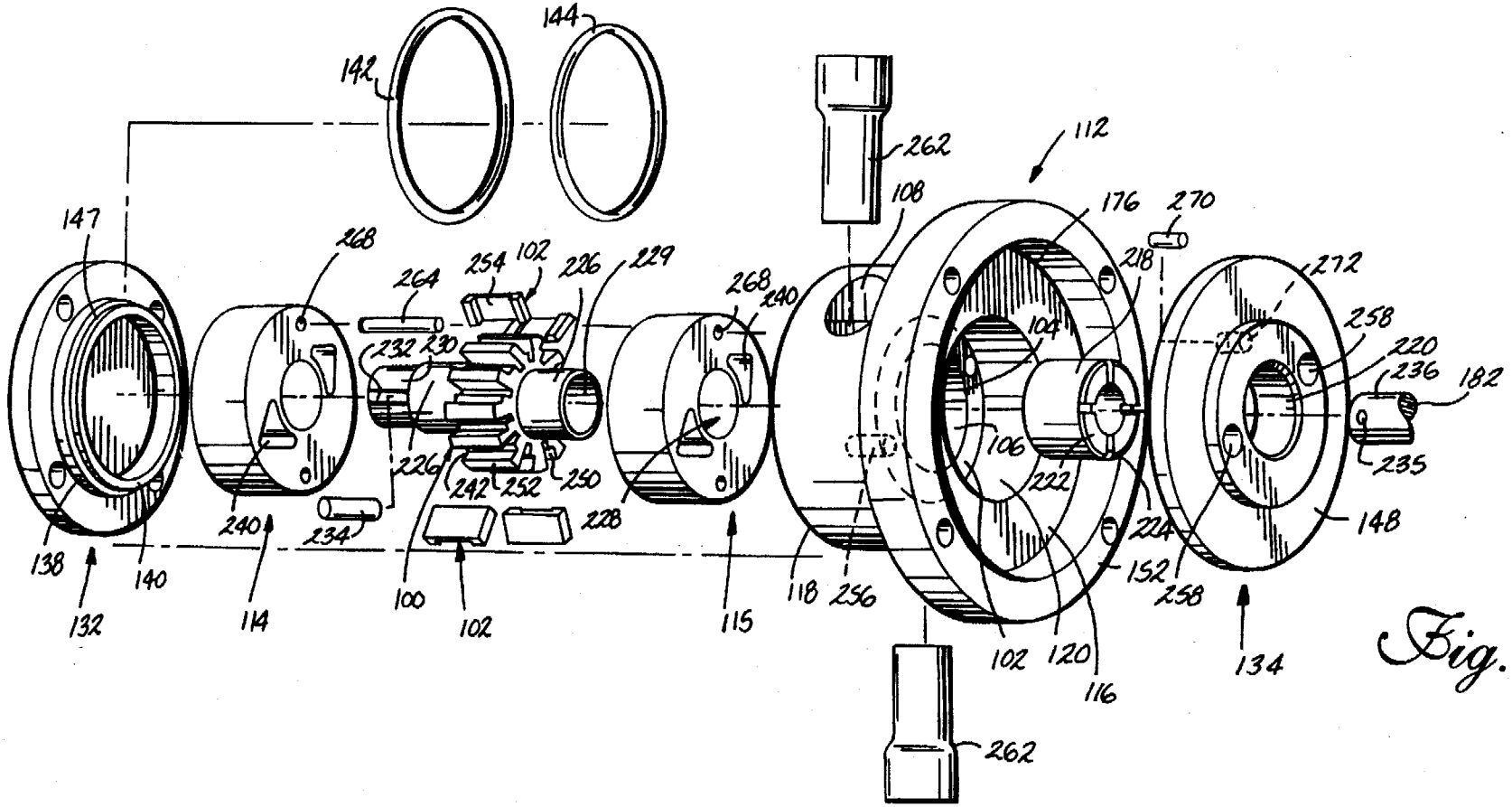
FIG. 5 is an exploded view of a pumping chamber of the pump of FIG. 2.

A central portion 212 of the motor shaft 182 is coaxially received within the motor rotor 188 and attaches thereto, as by press fitting. Adjacent the central portion 212, an annular flange 214 of a larger diameter than the central portion 212 extends outwardly radially from the motor shaft 182. A bearing-receiving portion 216 of the motor shaft 182, adjacent the annular flange 214, is machined to a fine tolerance and rotates within a carbon bushing bearing 218 supported within a coaxial bore 220 in the hub 134. Preferably, an outside edge of the hub bore 220, adjacent the motor 180, is slightly chamfered. The motor shaft annular flange 214 abuts one end 222 of the bushing bearing 218 and, as best seen in FIG. 5, the bushing bearing end 222 has four shallow radial grooves 224 spaced 90° apart from one another. The bearings 204 and 218 can be formed of Vespel™ material.

The pump rotor 100 has extending axially from either side thereof shaft portions 226 which are sized to rotate freely within central bores 228 in the disks 114 and 115. A rotor central bore 229 (FIG. 5) passes coaxially through the pump rotor 100, including the shaft portions 226, and coaxially receives the motor shaft 182. An outboard end of the pump rotor 230 has a key-way 232 for receiving a drive pin 234 which extends radially from an aperture 235 through a second end 236 of the motor shaft 182. The drive pin 234 thus provides positive engagement between rotation of the motor shaft 182 and the pump rotor 100. Alternatively, mating axial splines (not shown) can be provided on the rotor 100 internal of the rotor bore 229 and on the motor shaft second end 236 to slidably couple the two parts.

Turning to FIG. 3, fluid to be pumped, such as refrigerant enters the rotor chamber 106 through the two radial inlets 108. As the rotor 100 rotates, centrifugal force moves the vanes 102 outwardly to form a volume into which the fluid is pushed by inlet pressure. As the pump 54 is designed to pump incompressible fluids, the pumping chambers 130 have a constant volume to avoid compression of the pumped fluid 239 as it passes through the pumping chambers 130. At the end of its travel through the pumping chambers 130, the fluid moves out of the rotor chamber 106 and into two triangular-shaped apertures 240 in the disks 114, 115 on either side of the rotor chamber 106.

Turning also to FIG. 5, the vanes 102 operate in generally radial slots 242 in the pump rotor 100. The vane slots 242 are slightly canted in the direction of rotation to decrease stresses on the vanes 102 and thereby increase their wear life. Each of the vanes 102 has a high pressure side 244 and a low pressure side 246 and the vane high pressure side abuts a leading radial wall 248 in the vane slot 242. A slight axial groove 250 intersects an outer circumferential face of the rotor 252 at the leading radial wall 248 and provides an enlarged passageway for the pumped fluid to escape the pumping chambers 130 as the vanes reach the apertures 240. Without this provision, when used to pump a relatively small volume of fluid, the pumping chambers 130 must necessarily be very small at the intersection with the triangular disk apertures 240 and would otherwise thus create a flow restriction and decrease the overall efficiency of the pump 54.

Each vane 102 has a slight C-shape formed by a radially oriented rectangular groove 254 along its high pressure side 244 and facing the rotor axial grooves 250. The groove 254 channels pumped fluid around the vane 102 to seat it against the cam ring 104 and provides a passage for fluid to escape as the vane moves inwardly of the slot 242.

After the pumped fluid enters the triangular disk apertures 240 it flows axially through outlet bores 256 and 258 in the cam ring 104 and hub 134, respectively, which are aligned with the triangular apertures 240. The pumped fluid 238 passes through the motor housing 150 and exits the hermetic enclosure 184 through a discharge fitting 260 in the end bell 158. Similar fittings 262 are preferably provided in the pump housing 112 in communication with the radial inlets 108.

The pumped fluid 238 bathes the entire interior of the hermetic enclosure 184 to cool bearing surfaces and the motor 180. In particular, the pump fluid 238 cools the bushing bearings 204 and 218. During start-up of the pump 54, the hermetic enclosure 184 may not be completely filled with pumped fluid 238. Thus, the bushing bearing 204 and 218 should preferably be formed of a self-lubricating material such as carbon. Also, the end disks 114, 115 should also be formed of a similar self-lubricating material. The pump 54 must have a long service life. It is therefore imperative that the bushing bearing 204 and 218 remain viable throughout the life of the pump 54.

The pumping chambers 130 are aligned 180° apart across the rotor 100 whereby forces imparted upon the pumping rotor 100 are radially balanced. A high pressure force created on one side of the pump rotor 100 is balanced by a similar and equal high pressure force on an opposite side of the pump rotor (180 degrees across the rotor) to create a resultant zero force magnitude. Vibration of the pump rotor 100 and shaft 182 are kept to a minimum to preserve the integrity of the bushing bearings 204 and 218. It is understood of course, that self-lubricating bushing bearings of the type illustrated as 204 and 218 are susceptible to wear in an unprotected environment. The design of the pump 54 balances forces on the shaft 182 to preserve the integrity of the bearings 204 and 218 over the expected service life of the pump 54.

The pump is also preferably mounted in a vertical orientation with the motor 180 on top. This is to minimize radial loads on all bearings due to the weight of rotating parts, as well as to force any vapors, which might form from the vaporization of cold refrigerant as it absorbs heat in the motor, out the discharge 260 and into the system.

For ease in assembly and to more accurately align the disks 114 and 115 and hub 148 with the cam ring 104 for greatest pumping efficiency, an alignment pin 264 is disposed within aligned bores 266 and 268 in the cam ring 104 and disks 114 and 115 respectively, thereby positively and accurately locating the triangular-shaped disk apertures 240 with respect to the cam ring 104. Also, an additional alignment pin 270 is received within aligned bores 272 and 268 in the hub 134 and one of the disks 114, respectively to thereby align the hub outlet bores 258 with the triangular apertures 240 through the disk 114.

The materials of the pump components provide a long operating life and economical construction. Preferably, the vanes 102 are formed of a wear-resistant, self-lubricating material such as a self-lubricating composite of carbon and plastic. The disks 114, 115 and bushing bearings 204 and 218 are also preferably formed of a wear-resistant, serf-lubricating material such as a carbon-plastic composite material. The pump rotor 100 and motor shaft 182 are preferably formed of steel or other suitable material, especially as may be formed by powder metallurgy techniques. The hub 134, pump housing 112 and end cover 132 are formed of cast iron, and the motor housing 150 and end bell 158 are formed of steel. Cast iron, stamped metal or other legs 276 can be provided to support the pump 54.

The pump 54 is particularly suitable for transferring liquid or mixed phase refrigerant from an accumulator into an evaporator in a full-scale refrigeration system. The radially oriented inlets 108 reduce the net positive suction head (NPSH) required by the pump by providing little resistance to the flow of refrigerant entering the rotor chamber 106. As the refrigerant enters the rotor chamber 106 through one of the inlets 108, the vanes 102 seal a volume of the refrigerant into one of the constantly forming pumping chambers 130. As previously described, the pumping chambers 130 form between adjacent vanes 102, the rotor outer face 252 and the cam ring 104 within the drop central sections 128. The vanes 102 move the refrigerant through the pumping chamber 130 without compression as the drop central sections 128 are shaped to provide constant volume pumping chambers 130. The pumped refrigerant, or other pumped fluid, moves axially out of the pumping chamber 130 and into the triangular apertures 240 in the end dish 114 and 115. Flow into the aperture 240 in the outboard disk 114 travels through the cam ring outlet bore 256 into the aperture 240 in the inboard disk 115. From the aperture 240 in the inboard disk, the pumped refrigerant passes into the motor housing 150 through the hub outlet bore 258 and out of the pump 54 through the discharge fitting 260 in the end bell 158.

As the flow of refrigerant passes through the motor housing 150, it cools the motor 180 and bearings 204 and 218. Refrigerant also travels to other areas within the hermetic enclosure 184 to lubricate and cool all of the moving parts. For instance, low pressure areas forming in the rotor chamber 106 as the rotor 100 rotates tend to draw some of the low viscosity refrigerant 26 back into the rotor chamber 100 between the rotor shaft portions 226 and the end disks 114 and 115.

Flow enters duplicate pumping chamber 130 formed 180° across the rotor chamber 106 by the orientation of the drops 126. The symmetrical arrangement of the pumping chambers 130 balances radial forces acting on the rotor 100 to greatly reduce vibration and stresses on the various pump components. Combining balanced operation and self-lubricating bearings provides for long bearing life with high efficiency.

FIG. 6 shows a first alternative embodiment of the invention showing pump 54 driven by an attached canned motor shown generally at 400. Like numbers have been used to represent like parts. The pump 54 in the embodiment is substantially identical to the pump 54 shown in FIGS. 1–5 and will not be further described for purposes of brevity. Canned motor 400 includes an annular base 402 having a ridge 404 disposed along its interior side and a sleeve 406 disposed around the center of base 402. A cylindrical canned housing 408 includes a radially extending base 410 having a shoulder 412 which sealingly abuts ridge 404 on annular base portion 402 and defines a hermetically-sealed chamber 414. The canned housing 408 also includes a cap portion 416 at its distal end which includes an interior annular sleeve 418 disposed around the center of cap 416 directly opposite from sleeve 406. Annular sleeves 406 and 418 provide a housing for bushings 420 and 422, respectively. The distal end 426 of motor shaft 424 is rotatably installed within bushing 422 while the proximal end 428 of motor shaft 424 is rotatably installed within bushing 420. The proximal end 428 of motor shaft 424 extends through a central bore 430 in annular base 402 and directly into pumping chamber 106 within the pump housing 112. The central portion 432 of motor shaft 424 includes an attached annular rotor 434 having coils 436 wound around its exterior. A cylindrical motor housing 438 is axially disposed over canned housing 408 such that radially extending flange 440 at the base of motor housing 438 abuts the base 410 of canned housing 408 and the cap 416 of canned housing 408 is fittingly received within an aperture 442 of motor housing 438. A chamber 444 is defined between the interior wall of motor housing 438 and the exterior wall of canned housing 408. A stator 446 having coiled windings 448 is annularly installed in chamber 444 as a radial extension of the coil winding 436 of rotor 434. The stator 446 is electrically connected to external power supply 450 attached to the outer wall of canned housing 438.

During operation, the introduction of electrical power to the coil windings 448 of stator 446 imparts a rotational inertia on the coil windings 436 of rotor 434 through the longitudinal wall of canned housing 408. The motor shaft 424, attached to rotor 434, rotates with the rotor 434, thus imparting the necessary rotary motion required by the pump 54.

FIG. 7 shows a second alternative embodiment of the invention comprising a magnetically-coupled pump shown generally at 500. The pump 54 and its various elements are identical to previous embodiments and are referred to by the same reference numerals used in applications of this type in previous figures. The difference in this embodiment is that pump motor 180 has been replaced with a magnetically-coupled drive motor 500. The magnetically-coupled motor 500 comprises an interior driven magnet assembly 502, an exterior drive magnet assembly 504 and a rotary power supply 506. The rotary power supply 506 is shown in outline form and may comprise any conventional rotary motor used to drive the exterior drive magnet assembly 504.

The interior driven magnet assembly 502 comprises an annular base 508 and a containment shell 510 which house a driven shaft 512 and a driven magnet assembly 514. The annular base 508 is held in a abuttingly-sealed relationship with pump housing 112 by a plurality of threaded fasteners 516. A bushing 518 is disposed within a central bore 520 of annular base 508 and houses the motor shaft 512 as it enters pump rotor chamber 106. The containment shell 510 comprises an annular wall 522 extending axially outward from a shoulder 524 of annular base 508 and a rounded cap 526 at the distal end of annular wall 522 creating a hermetically-sealed interior chamber 528. Driven shaft 512 includes a distal narrow-radius portion 530 onto which driven magnet assembly 514 is inserted and held in place by any conventional locking means, such as locking ring 532, for example. The driven magnet assembly comprises a radially-extending annular flange 534 having a plurality of driven magnets 536 located around its exterior edge 538. The driven magnet assembly 514 extends radially outward from driven shaft 512 to the extent that only a very small gap is left between the exterior edge 538 of the annular flange 534 and the attached magnets 536 and the interior wall of containment shell 510.

The exterior drive magnet assembly 504 includes an annular housing 540 abutting the base 508 of the driven magnet assembly 502 at its proximal end 542 and threadingly fastened to exterior rotary power supply 506 by a plurality of threaded fasteners 544 at its distal end 546. The proximal end 542 of annular housing 540 includes a lubrication port, 550 leading into a channel 552 in the housing 540. Threaded stud 554 may be placed into the port 550 after the introduction of lubricating fluid into the port 550. The housing 540 of the exterior drive magnet assembly 504 defines a chamber 556 located between the interior wall of housing 540 and the exterior wall of containment shell 510. Drive shaft 558 extends into chamber 556 from exterior rotary power supply 506 and is rotatably supported in a bushing 560. The drive shaft 558 terminates shortly after entering chamber 556. A rotor flange 562 is attached to the chamber end of the drive shaft 558 and comprises a narrow annular portion 564 lockingly installed around the circumference of drive shaft 558, a radially extending portion 566 from the terminal end of annular portion 564, and a flange 568 extending longitudinally into the gap defined by the area between the annular wall 522 of container shell 510 and the interior wall of housing 540. Several drive magnets 570 are disposed along the inner distal wall of flange 568 and extend towards the exterior wall 522 of container shell 510. Such that only a small gap between the drive magnets 570 and the container shell is defined.

During operation, the exterior rotary power supply 506 imparts rotary motion to drive shaft 558 causing the drive magnets 570 attached to rotor flange 562 to rotate about the annular wall 522 of container shell 510. As the drive magnets 570 rotate around the exterior of the container shell 510, the driven magnets 536 located in the interior of the container shell 510 are magnetically driven in a synchronous rotation with the exterior magnets 570 causing the attached driven shaft 512 to be rotated also, thus imparting the required rotary motion to operate pump 54 in the manner described earlier in this description. Special consideration should be given to the selection of the exterior rotary power supply 506 and composition of drive magnets 570 and driven magnets 536 to prevent the accidental decoupling of the motor 500. Decoupling occurs when the magnetic attractive force between driven magnets 536 and drive magnets 570 is required to produce a torque to cause rotation in access of what is physically available. Decoupling usually results in the driven shaft coming to a stop when the drive shaft continues to rotate.

While the invention has been particularly described in connection with specific embodiments thereof, it is to be understood that this is by way of illustration and not of limitation, and that the scope of the appended claim should be construed as broadly as the prior art will permit. While the hermetic configuration disclosed employs a serviceable construction employing O-rings, the hermetic enclosure 184 can be sealed by means of welding or brazing. If desired, the pump 54 can be configured so that flow enters and exits the rotor chamber 106 either axially or radially. While the pump 54 is particularly well suited for the disclosed services in the combined multi-modal air conditioning with negative energy storage and liquid overfeed refrigeration systems, it provides similar advantages in other services such as the transfer of liquified gases or hazardous substances.

What is claimed is:

1. A constant volume, balanced rotor, hermetically sealed vane pump comprising:

an hermetic enclosure comprising a hollow pump housing;

the pump housing having a circumferential wall defining a generally elliptical rotor chamber having opposed circular portions, opposed cam portions angularly spaced from the circular portions, and an inlet port connected to each cam portion at a leading edge thereof;

an end wall at each axial end of the rotor chamber further defining the rotor chamber, the circumferential wall and end walls defining a chamber housing, the end walls further comprising disk bearings mounted wholly within the pump housing;

an outlet port extending from each cam portion at a trailing edge thereof to a discharge port in the hermetic enclosure;

a cylindrical pump rotor rotatably supported on the disk bearings wholly within the pump housing for rotation in the rotor chamber and having a plurality of radially extending, slidably mounted vanes adapted to form a constant volume pumping chamber defined between each pair of adjacent vanes, the rotor, and the circumferential and end walls at the cam portions between each inlet port and each outlet port;

each of the cam portions, inlet ports and outlet ports being located 180 degrees apart from the other of the respective cam portions, inlet ports and outlet ports whereby radial forces on the pump rotor are balanced; and a motor with an output shaft coupled to the pump rotor for driving the pump rotor.

2. A pump according to claim 1 wherein the disk bearings are formed of a serf-lubricating material.

3. A pump according to claim 1 wherein the hermetic enclosure further comprises a motor housing containing the motor, the motor housing being joined to the pump housing in axial alignment and wherein:

the motor comprises a stator mounted within the motor housing, a motor rotor disposed within the stator for rotation and a motor shaft mounted to the motor rotor and extending axially from a first and second axial end of the rotor, and further comprising:

bearing supports wholly within the motor housing mounting motor bearings at the first and second ends of the motor rotor, the bearings supporting the motor shaft;

a slidable drive coupling between the motor shaft and the pump rotor for slight axial and radial movement between the two; and an outlet port is provided through the motor housing.

4. A pump according to claim 2 wherein the outlet ports include passages which extend through one of the end walls into the motor housing wherein the fluid to be pumped can cool the motor bearings.

5. A pump according to claim 2 wherein the motor bearings are self-lubricating carbon bearings and are cooled by fluid pumped from the outlet port.

6. A pump according to claim 1 wherein the motor shaft is slidably coupled to the pump rotor.

7. A pump according to claim 1 wherein the pump rotor has an axially extending keyway and the shaft has a radially extending pin disposed within the keyway whereby the motor shaft slidably couples to the pump rotor.

8. A pump according to claim 1 wherein the pump rotor has a series of slots in which the vanes are slidably mounted, each slot having a radial outer end and a leading radial wall; and the pump rotor further has a groove at the outer end of each slot at its leading radial wall to decrease a flow restriction upon a pumped fluid leaving the rotor chamber.

9. A pump according to claim 1 wherein the axial openings are triangular in shape and have one side along the rotor chamber and an apex radially spaced from the rotor chamber and wherein the axial openings are aligned with an axially oriented bypass passage through the pump housing, the axially oriented bypass passage being radially displaced from the rotor chamber.

10. A pump according to claim 1 wherein said pump rotor is supported on said motor output shaft.

11. A pump according to claim 1 wherein said motor output shaft is mechanically coupled to said pump rotor.

12. A pump according to claim 1 wherein said motor output shaft is magnetically coupled to said pump rotor.

13. A pump according to claim 1 where said hermetic enclosure further comprises a motor housing containing the motor, the outlet ports are connected to the motor housing for transporting fluid from the pump to said motor housing, and the discharge port extends through the motor housing.

14. A constant volume, balanced rotor, hermetically sealed vane pump comprising:

an hermetic enclosure comprising a hollow pump housing and a motor housing with an outlet opening therethrough, the motor housing and pump housing being joined in axial alignment;

the pump housing having a circumferential wall defining a generally elliptical rotor chamber having opposed circular portions, opposed cam portions angularly spaced from the circular portions, and an inlet port connected to each cam portion at a leading edge thereof;

an end wall at each axial end of the rotor chamber further defining the rotor chamber, the circumferential wall and end walls defining a chamber housing;

an outlet port extending from each cam portion at a trailing edge thereof to a discharge port in the hermetic enclosure;

a cylindrical pump rotor rotatably supported wholly within the pump housing for rotation in the rotor chamber and having a plurality of radially extending, slidably mounted vanes adapted to form a constant volume pumping chamber defined between each pair of adjacent vanes, the rotor, and the circumferential and end walls at the cam portions between each inlet port and each outlet port;

each of the cam portions, inlet ports and outlet ports being located 180 degrees apart from the other of the respective cam portions, inlet ports and outlet ports whereby radial forces on the pump rotor are balanced;

a motor with an output shaft coupled to the pump rotor for driving the pump rotor;

the motor comprises a stator mounted within the motor housing, a motor rotor disposed within the stator for rotation and a motor shaft mounted to the motor rotor and extending axially from a first and second axial end of the rotor, and further comprising:

bearing supports, wholly within the motor housing, mounting motor bearings at the first and second ends of the motor rotor, the bearings supporting the motor shaft, at least one of said bearing supports has an opening for liquid to pass therethrough;

a slidable drive coupling between the motor shaft and the pump rotor for slight axial and radial movement between the two; and the outlet ports include passages which extend through one of the end walls into the motor housing wherein the fluid to be pumped can cool the bearings.

15. A pump according to claim 14 wherein the motor bearings are self-lubricating.

16. A pump according to claim 15 wherein the motor bearings are formed of carbon.

17. A constant volume, balanced rotor, hermetically sealed vane pump comprising:

an hermetic enclosure comprising a hollow pump housing;

the pump housing having a circumferential wall defining a generally elliptical rotor chamber having opposed circular portions, opposed cam portions angularly spaced from the circular portions, and an inlet port connected to each cam portion at a leading edge thereof;

an end wall at each axial end of the rotor chamber further defining the rotor chamber, the circumferential wall and end walls defining a chamber housing;

an outlet port extending from each cam portion at a trailing edge thereof to a discharge port in the hermetic enclosure, the outlet ports extend through both of end walls, the outlet ports are triangular in shape, having one side along the rotor chamber and an apex radially spaced from the rotor chamber and aligned with an axially oriented passage through the pump housing, the axially oriented passage being radially displaced from the rotor chamber;

a cylindrical pump rotor rotatably supported wholly within the pump housing for rotation in the rotor chamber and having a plurality of radially extending, slidably mounted vanes adapted to form a constant volume pumping chamber defined between each pair of adjacent vanes, the rotor, and the circumferential and end walls at the cam portions between each inlet port and each outlet port;

each of the cam portions, inlet ports and outlet ports being located 180 degrees apart from the other of the respective cam portions, inlet ports and outlet ports whereby radial forces on the pump rotor are balanced; and a motor with an output shaft coupled to the pump rotor for driving the pump rotor.

* * * * *